US008967028B2

(12) United States Patent
Yamada et al.

(10) Patent No.: US 8,967,028 B2
(45) Date of Patent: Mar. 3, 2015

(54) SHEET CUTTING DEVICE AND IMAGE FORMING APPARATUS INCLUDING THE SHEET CUTTING DEVICE

(75) Inventors: Masahiko Yamada, Tokyo (JP); Kazuhiro Wakamatsu, Kanagawa (JP); Yuichiro Maeyama, Kanagawa (JP); Masato Ogawa, Kanagawa (JP); Toshihiro Yoshinuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 284 days.

(21) Appl. No.: 13/402,238

(22) Filed: Feb. 22, 2012

(65) Prior Publication Data

US 2012/0222532 A1 Sep. 6, 2012

(30) Foreign Application Priority Data

Mar. 4, 2011 (JP) ..... 2011-047727

(51) Int. Cl.
*B26D 1/18* (2006.01)

(52) U.S. Cl.
USPC ..... 83/483; 83/401; 83/500

(58) Field of Classification Search
USPC ..... 83/401, 477.2, 483, 485, 486, 500
See application file for complete search history.

(56) References Cited

U.S. PATENT DOCUMENTS

2011/0063644 A1 3/2011 Niihara et al.
2011/0064497 A1 3/2011 Niihara et al.

FOREIGN PATENT DOCUMENTS

JP 9-323289 12/1997
JP 2000-272117 10/2000

OTHER PUBLICATIONS

U.S. Appl. No. 13/293,517, filed Nov. 10, 2011.
U.S. Appl. No. 13/306,029, filed Nov. 29, 2011.
U.S. Appl. No. 13/307,157, filed Nov. 30, 2011.
U.S. Appl. No. 13/352,591, filed Jan. 18, 2012.
U.S. Appl. No. 13/366,427, filed Feb. 6, 2012.
U.S. Appl. No. 13/366,466, filed Feb. 6, 2012.

*Primary Examiner* — Sean Michalski
(74) *Attorney, Agent, or Firm* — Cooper & Dunham LLP

(57) ABSTRACT

A sheet cutting device includes a cutter holder, a moving unit, and a guide member. The cutter holder accommodates a cutter. The cutter has opposed blades opposing each other to cut a sheet of recording media fed along a sheet feed path of a feed guide plate unit. The moving unit holds the cutter holder and is movable in a sheet width direction perpendicular to a sheet feed direction in which the sheet is fed along the sheet feed path. The guide member is disposed along the sheet width direction to guide the moving unit in the sheet width direction. The cutter holder partially overlaps with the feed guide plate unit in a thickness direction of the sheet perpendicular to both the sheet width direction and the sheet feed direction.

17 Claims, 12 Drawing Sheets

SHEET CUTTING DEVICE AND IMAGE FORMING APPARATUS INCLUDING THE SHEET CUTTING DEVICE

CROSS-REFERENCE TO RELATED APPLICATION

This patent application is based on and claims priority pursuant to 35 U.S.C. §119 to Japanese Patent Application No. 2011-047727, filed on Mar. 4, 2011, in the Japan Patent Office, the entire disclosure of which is hereby incorporated by reference herein.

BACKGROUND

1. Technical Field

This disclosure relates to a sheet cutting device and an image forming apparatus including the sheet cutting device, and more specifically to a sheet cutting device to cut a rolled sheet to a desired length and an image forming apparatus including the sheet cutting device.

2. Description of the Related Art

Image forming apparatuses are used as printers, facsimile machines, copiers, plotters, or multi-functional devices having two or more of the foregoing capabilities. As a conventional type of image forming apparatus, an image forming apparatus is known that feeds a long-size rolled sheet (hereinafter, rolled sheet) in a certain feed direction (hereinafter, sheet feed direction) to form an image on the rolled sheet. The image forming apparatus typically has a sheet cutting device to cut the rolled sheet to a desired length.

As the sheet cutting device, for example, JP-9-323289-A proposes a sheet cutting device that has a cutter holder accommodating a cutter. For the sheet cutting device, the cutter holder cuts the rolled sheet with the cutter while moving to one end in a width direction of the rolled sheet perpendicular to the sheet feed direction. After cutting the sheet, the cutter holder returns to the other end in the width direction of the sheet to prepare for the next sheet cutting.

However, for the sheet cutting device, the cutter holder is typically disposed between a platen for retaining the rolled sheet thereon during printing and a discharge guide plate for guiding the rolled sheet discharged to the outside of the apparatus after printing is finished. Such a configuration needs a space enabling the cutter holder to be located between the platen and the discharge guide plate. Actually, such a space is dimensioned to have a width equal to or greater than a width of the cutter holder in the sheet feed direction. As a result, the width of the image forming apparatus in the sheet feed direction increases by the space of the cutter holder, thus resulting in an increased size of the image forming apparatus.

BRIEF SUMMARY

In an aspect of this disclosure, there is provided a sheet cutting device including a cutter holder, a moving unit, and a guide member. The cutter holder accommodates a cutter. The cutter has opposed blades opposing each other to cut a sheet of recording media fed along a sheet feed path of a feed guide plate unit. The moving unit holds the cutter holder and is movable in a sheet width direction perpendicular to a sheet feed direction in which the sheet is fed along the sheet feed path. The guide member is disposed along the sheet width direction to guide the moving unit in the sheet width direction. The cutter holder partially overlaps with the feed guide plate unit in a thickness direction of the sheet perpendicular to both the sheet width direction and the sheet feed direction.

In another aspect of this disclosure, there is provided an image forming apparatus including an image forming device, a sheet feed device, and the above-described sheet cutting device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
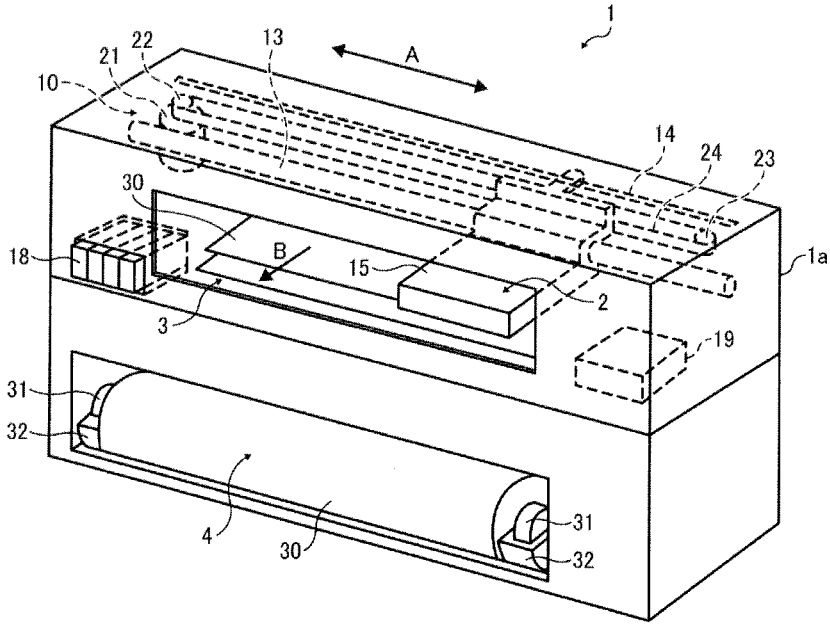
FIG. 1 is a schematic perspective view of an inkjet recording apparatus having a sheet cutting device according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

FIGS. 1 to 18 show a sheet cutting device and an image forming apparatus according to an exemplary embodiment of the present disclosure. In FIGS. 1 to 18, an inkjet recording apparatus is illustrated as an example of the image forming apparatus.

Figure 2:
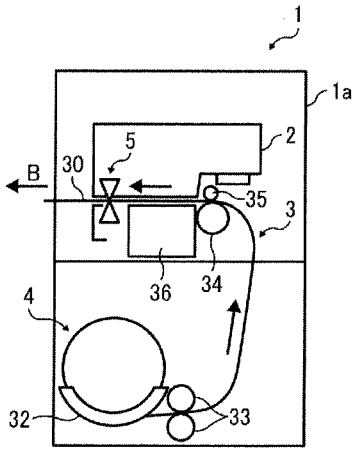
FIG. 2 is a schematic side view of the inkjet recording apparatus illustrated in FIG. 1.

In FIGS. 1 and 2, an inkjet recording apparatus 1 serving as the image forming apparatus is a serial-type inkjet recording apparatus that moves an inkjet recording head in a width direction (hereinafter, sheet width direction) of a sheet for scanning to form an image on the sheet. After one or more scans are performed to form a line of the image, the inkjet recording apparatus 1 feeds the sheet forward a certain distance to form another line of the image. It is to be noted that the image forming apparatus is not limited to the serial-type inkjet recording apparatus but may be, for example, a line-type inkjet recording apparatus having a recording head in which multiple nozzles are arranged across a substantially whole area in the width direction of a sheet to record an image on the sheet without scanning in the width direction.

The inkjet recording apparatus 1 includes an image forming section 2 serving as an image forming device, a sheet feed section 3 serving as a sheet feed device, a rolled sheet storage section 4, and a sheet cutting device 5. The image forming section 2, the sheet feed section 3, the rolled sheet storage section 4, and the sheet cutting device 5 are disposed within an apparatus main unit 1*a*.

In the image forming section 2, a guide rod 13 and a guide rail 14 extend between side plates, and a carriage 15 is supported by the guide rod 13 and the guide rail 14 so as to be slidable in a direction indicated by an arrow A in FIG. 1.

The carriage 15 holds liquid ejection heads (recording heads) to eject ink droplets of, e.g., black (K), yellow (Y), magenta (M), and cyan (C). Sub tanks are integrally molded with the corresponding recording heads to supply color inks to the respective recording heads.

A main scanning mechanism 10 moves the carriage 15 for scanning in a main scanning direction, that is, the sheet width direction indicated by the arrow A in FIG. 1. As illustrated in FIG. 1, the main scanning mechanism 10 includes a carriage driving motor 21 disposed at a first end in the sheet width direction, a driving pulley 22 rotated by the carriage driving motor 21, a driven pulley 23 disposed at a second end opposite the first end in the sheet width direction, and a belt member 24 looped around the driving pulley 22 and the driven pulley 23. A tension spring tensions the driven pulley 23 outward, that is, away from the driving pulley 22. A portion of the belt member 24 is fixed to and held by a belt fixing portion at a rear side of the carriage 15 to draw the carriage 15 in the sheet width direction.

To detect a main scanning position of the carriage 15 in the main scanning direction, an encoder sheet is disposed along the sheet width direction in which the carriage 15 moves. An encoder sensor is disposed at the carriage 15 and reads the encoder sheet to detect the main scanning position of the carriage 15.

In a recording area of a main scanning region of the carriage 15, the rolled sheet 30 is intermittently fed by the sheet feed section 3 in a direction perpendicular to the sheet width direction, that is, a sheet feed direction indicated by an arrow B in FIG. 1.

Outside a movement range of the carriage 15 in the sheet width direction or at a first end side of the main scanning region of the carriage 15, main cartridges 18 are removably mounted to the apparatus main unit 1*a* to store the respective color inks to be supplied to the sub tanks of the recording heads. At a second end side of the main scanning region opposite the first end side, a maintenance unit 19 is disposed to maintain and recover desirable conditions of the recording heads.

The rolled sheet storage section 4 serves as a sheet feed unit into which the rolled sheet 30 serving as a sheet material for image recording is set. As the rolled sheet 30, rolled sheets of different widths can be set to the rolled sheet storage section 4. The rolled sheet 30 includes a sheet shaft, and flanges 31 are mounted at opposed ends of the sheet shaft. By mounting the flanges 31 to flange bearings 32 of the rolled sheet storage section 4, the rolled sheet 30 is stored in the rolled sheet storage section 4. The flange bearings 32 include support rollers to rotate the flanges 31 while contacting the outer circumferences of the flanges 31 to feed the rolled sheet 30 to a sheet feed path.

As illustrated in FIG. 2, the sheet feed section 3 includes a pair of sheet feed rollers 33, a registration roller 34, a registration pressing roller 35, and a sheet suction feeding mechanism 36. The pair of sheet feed rollers 33 feeds the rolled sheet 30 from the rolled sheet storage section 4 to the sheet feed path. The registration roller 34 and the registration pressing roller 35 are disposed upstream from the image forming section 2 in the sheet feed direction to feed the rolled sheet 30 to the sheet cutting device 5 via the image forming section 2.

The sheet suction feeding mechanism 36 is disposed below the image forming section 2 via the sheet feed path and performs suctioning operation to attract the rolled sheet 30 onto a platen 80 (see FIG. 11) at an upper face of the sheet suction feeding mechanism 36. Thus, the flatness of the rolled sheet 30 fed below the image forming section 2 is maintained.

After the rolled sheet 30 is fed from the rolled sheet storage section 4, the sheet feed section 3 feeds the rolled sheet 30 forward (toward the left side in FIG. 2) from the rear side (right side in FIG. 2) of the apparatus main unit 1*a* to the recording area below the image forming section 2. When the rolled sheet 30 is fed to the recording area, the carriage 15 reciprocally moves back and forth in the sheet width direction and the recording heads eject ink droplets in accordance with image information. In addition, while the rolled sheet 30 is intermittently fed forward, the recording heads repeatedly eject ink droplets onto the rolled sheet 30 to record lines of a desired image on the rolled sheet 30. Thus, the whole image is formed on the rolled sheet 30 in accordance with the image information.

After image formation, the sheet cutting device 5 cuts the rolled sheet 30 to a desired length, and the cut sheet is discharged to a sheet output tray at the front side of the apparatus main unit 1*a*.

Figure 3:
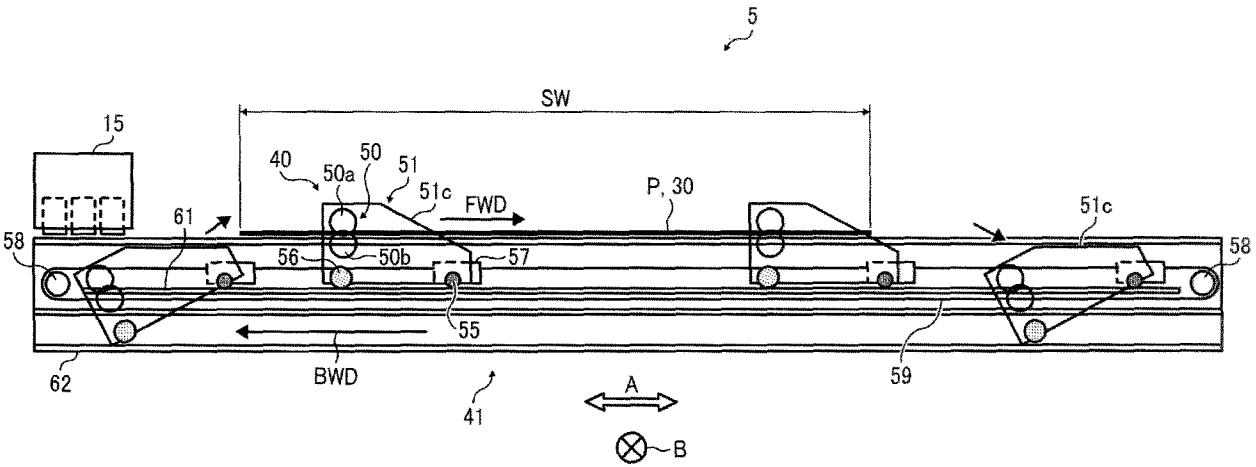
FIG. 3 is a schematic back view of the sheet cutting device illustrated in FIG. 1.

Next, the sheet cutting device 5 in this exemplary embodiment is described with reference to FIGS. 3 to 7. FIG. 3 is a schematic view of the sheet cutting device 5 seen from the back side of the apparatus main unit 1*a*.

Figure 4A:
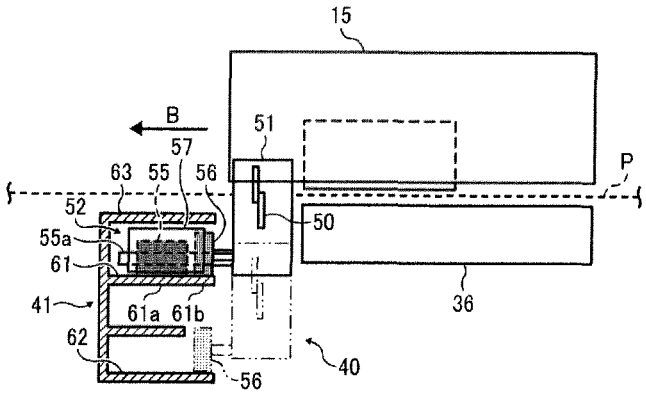
FIG. 4A is a partially cross-sectional side view of the sheet cutting device.
Figure 4B:
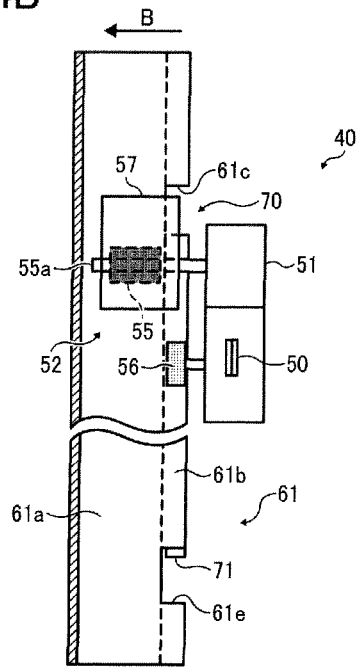
FIG. 4B is a partially cross-sectional plan view of the sheet cutting device.

As illustrated in FIGS. 3, 4A, and 4B, the sheet cutting device 5 is disposed downstream from the image forming section 2 in the sheet feed direction (see FIG. 2) and has a cutter assembly 40 and a guide member 41. The sheet cutting device 5 cuts the rolled sheet 30 fed along the sheet feed path to a desired length.

The cutter assembly 40 has a cutter holder 51 to accommodate a cutter 50 and a moving unit 52 to move the cutter holder 51 in the sheet width direction.

The cutter 50 is formed with circular blades 50*a* and 50*b*. The circular blades 50*a* and 50*b* are disposed opposing each other and rotatably held by the cutter holder 51. With movement of the cutter holder 51 in the sheet width direction indicated by an arrow A in FIG. 3, the circular blades 50*a* and 50*b* receive a driving force to rotate. In other words, the cutter 50, while rotating the circular blades 50*a* and 50*b*, cuts the rolled sheet 30 and thus is capable of cutting, e.g., a relatively thick rolled sheet. The cutter 50 is also formed with the circular blades, thus preventing a failure, such as uneven wearing of a particular portion as in a stationary blade. It is to be noted that the number of circular blades is not limited to two and the cutter 50 may have a single circular blade or three or more circular blades. For example, in a case where the cutter 50 has a single circular blade, it is preferable to further provide a stationary linear blade extending in the moving direction of the cutter 50. In this exemplary embodiment, the circular blades 50*a* and 50*b* serve as blades of the cutter.

The cutter holder 51 can be reciprocally moved in the sheet width direction by the moving unit 52. When the cutter holder 51 moves along a forward path (indicated by an arrow FWD in FIG. 3) from the second end side to the first end side of the apparatus main unit 1*a*, the cutter 50 cuts the rolled sheet 30. By contrast, along a backward path (indicated by an arrow BWD in FIG. 3), the cutter holder 51 moves from the first end side to the second end side of the apparatus main unit 1*a* to return to an initial position (hereinafter, home position), with the cutter holder 51 retracted from the sheet feed path downward in a thickness direction of the rolled sheet 30, that is, the vertical direction. As a result, on the backward path, the cutter holder 51 is placed away from the sheet feed path (indicated by a solid line P in FIG. 3) so as not to block the sheet feed path. The cutter holder 51 is detected with detectors, e.g., micro switches, disposed at opposed ends in the sheet width direction and controlled based on detection results of the detectors. The configuration of the cutter holder 51 is further described below.

In this exemplary embodiment, the above-described forward path serves as a first path of the cutter holder and the above-described backward path serves as a second path of the cutter holder.

The moving unit 52 has a driving roller 55, a driven roller 56, and a main body 57 to move the cutter holder 51 in the sheet width direction.

The driving roller 55 is made of, e.g., rubber and rotatably held in the main body 57. The main body 57 is connected to a wire 59 that is wound around a pair of pulleys 58 disposed at the opposed end sides of the apparatus main unit 1*a* in the sheet width direction. The wire 59 circulates in the sheet width direction via the pulleys 58 rotated by a driving motor. As a result, the driving roller 55, while rotating, moves on an upper guide rail 61 with the circulation of the wire 59. The moving unit 52 is movable in the sheet width direction with the movement of the driving roller 55. The driving roller 55 is connected to the cutter holder 51 via a rotation shaft 55*a* to support the cutter holder 51.

Figure 12A:
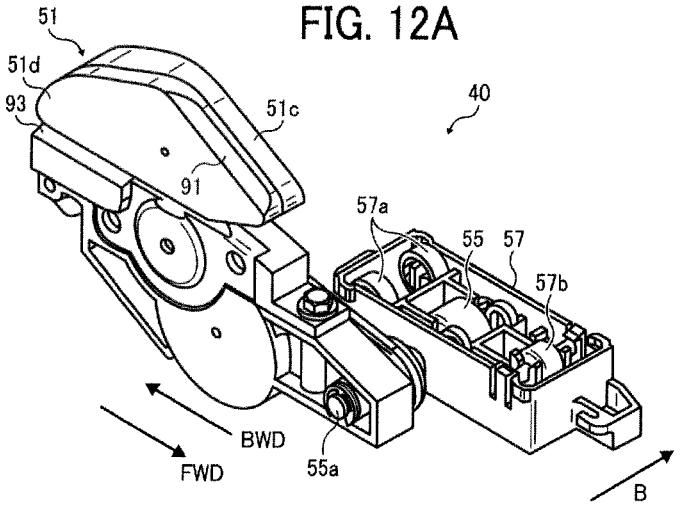
FIG. 12A is a perspective view of a cutter assembly seen from the back side.
Figure 12B:
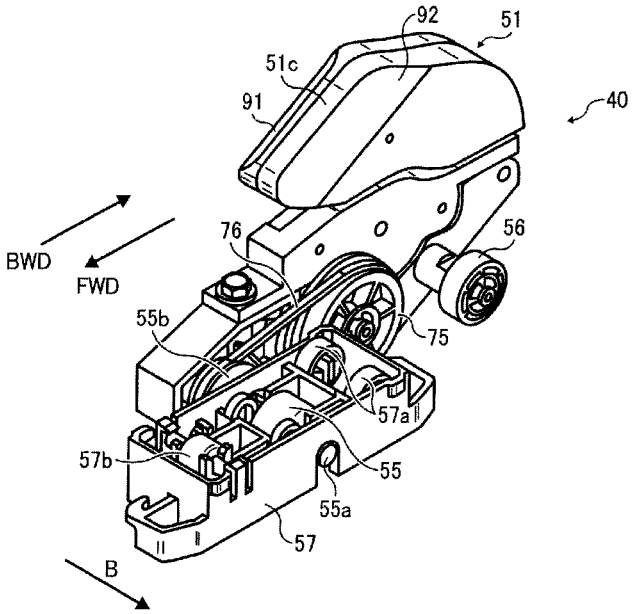
FIG. 12B is a perspective view of the cutter assembly seen from the front side.

As illustrated in FIGS. 12A and 12B, the main body 57 bears the rotation shaft 55*a* to rotatably hold (support) the driving roller 55. The main body 57 of the moving unit 52 is movable in the sheet width direction between the upper guide rail 61 and an upper guide plate 63 (see FIGS. 4A and 4B). The main body 57 is provided with first auxiliary rollers 57*a* and a second auxiliary roller 57*b*. Of the first auxiliary rollers 57*a* and the second auxiliary roller 57*b*, the auxiliary roller 57*b* is urged upward by an urging member. Each of the first auxiliary rollers 57*a* and the second auxiliary roller 57*b* contacts the upper guide plate 63 (see FIG. 4A) to urge the driving roller 55 onto the upper guide rail 61. As a result, friction resistance arises between the driving roller 55 and the upper guide rail 61, thus allowing the driving roller 55 to rotate with the movement of the main body 57.

A first pulley 55*b* is mounted on the rotation shaft 55*a* so as to be integrally rotatable with the rotation shaft 55*a*. A second pulley 75 is mounted on the cutter holder 51 to transmit the rotation driving force to the cutter 50, and an endless belt 76 is wound around the first pulley 55*b* and the second pulley 75. As a result, with movement of the main body 57 in the sheet width direction, the rotation driving force is transmitted to the cutter 50 via the rotation shaft 55*a*, the first pulley 55*b*, the endless belt 76, and the second pulley 75, thus rotating the circular blades 50*a* and 50*b*.

As illustrated in FIGS. 3, 4A, and 4B, the driven roller 56 is rotatably disposed away from the driving roller 55 in the sheet width direction. The driven roller 56 moves on an upper guide rail 61 along the forward path of the cutter holder 51 and on a lower guide rail 62 along the backward path. In other words, during movement of the cutter holder 51, the driven roller 56 serves as a positioning member (portion) to position the cutter holder 51 on the upper guide rail 61 and the lower guide rail 62. It is to be noted that the positioning member of the cutter holder 51 is not limited to the driven roller 56 but may be, for example, a circular-arc protrusion.

On switching the moving path between the forward path and the backward path, the cutter holder 51 pivots around the rotation shaft 55*a* of the driving roller 55 in the vertical direction. Thus, the cutter holder 51 switches between a first position with which, on the forward path, the cutter holder 51 cuts the rolled sheet 30 with the cutter 50 and a second position with which, on the backward path, the cutter holder 51 is retracted from the sheet feed path.

As illustrated in FIG. 4A, the driving roller 55 and the driven roller 56 are offset from each other in the sheet feed direction indicated by an arrow B. Specifically, the driven roller 56 is arranged upstream from the driving roller 55 in the sheet feed direction. As a result, with the driving roller 55 retained on the upper guide rail 61, the driven roller 56 is movable between the upper guide rail 61 and the lower guide rail 62, thus allowing the cutter holder 51 to pivot around the rotation shaft 55*a* of the driving roller 55. In FIG. 4A, a broken line P extending in the direction indicated by the arrow B represents the sheet feed path. In this exemplary embodiment, as illustrated in FIG. 4A, the cutter holder 51 is disposed within the width of the carriage 15 in the sheet feed direction. Alternatively, for example, the cutter holder 51 may be disposed away from the carriage 15 at the upstream or downstream side in the sheet feed direction.

As illustrated in FIG. 3, the cutter holder 51 has a slanted face 51*c* slanted at a predetermined angle from the sheet feed path (indicated by the solid line P) toward the vertical direction. The slant angle of the slanted face 51*c* is set so that the slanted face 51*c* is parallel to the sheet feed path when the cutter holder 51 moves along the backward path.

As illustrated in FIG. 3, the guide member 41 is a guide member to guide the movement of the moving unit 52 in the sheet width direction, and includes the upper guide rail 61 extending in the sheet width direction for a length that is at least longer than the width (sheet feed width) of the sheet feed path indicated by an arrow SW, and the lower guide rail 62 disposed away from the sheet feed path downward in the vertical direction. As illustrated in FIG. 4A, the guide member 41 has the upper guide plate 63 above the upper guide rail 61. The guide member 41 forms the forward path of the cutter holder 51 on the upper guide rail 61 and the backward path of the lower guide rail 62 on the lower guide rail 62. In this exemplary embodiment, the upper guide rail 61 and the lower guide rail 62 are formed as a single member (the guide member 52). Alternatively, the upper guide rail 61 and the lower guide rail 62 may be formed as separate members.

As illustrated in FIGS. 4A and 4B, the upper guide rail 61 has a driving-roller guide area 61*a* to guide the driving roller 55 in the sheet width direction and a driven-roller guide area 61*b* to guide the driven roller 56 so that the cutter holder 51 moves along the forward path. In this exemplary embodiment, the driving-roller guide area 61*a* and the driven-roller guide area 61*b* are formed as a single rail, that is, the upper guide rail 61. Alternatively, the driving-roller guide area 61*a* and the driven-roller guide area 61*b* may be formed as separate rails.

Figure 6:
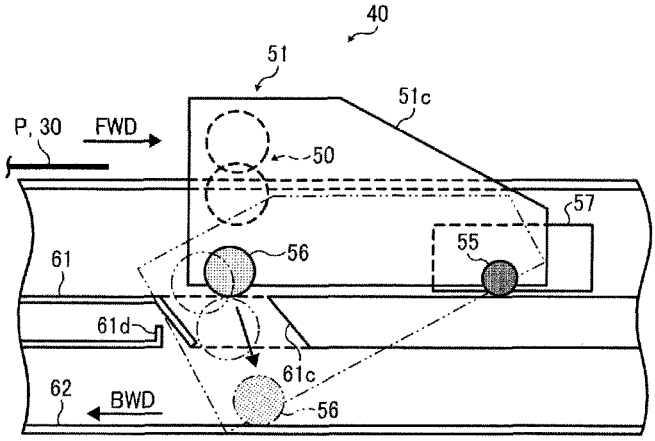
FIG. 6 is a schematic view of the cutter holder shifting to a backward path.

At a first end side of the driven-roller guide area 61*b* in the sheet width direction, a first connection path 61*c* is formed to switch the moving path of the cutter holder 51 from the forward path to the backward path. As illustrated in FIG. 6, the first connection path 61*c* is formed at the upper guide rail 61 so as to connect the forward path (indicated by an arrow FWD) on the upper guide rail 61 to the backward path (indicated by an arrow BWD) on the lower guide rail 62. Specifically, a portion of the upper guide rail 61 is cut out at the first end side in the sheet width direction and folded so as to slant downward at a certain angle, thus forming the first connection path 61*c*. Thus, the first connection path 61*c* allows the driven roller 56 to move from the upper guide rail 61 to the lower guide rail 62 after the rolled sheet is cut with the cutter 50. A lower end portion 61*d* of the upper guide rail 61 adjacent to the first connection path 61*c* is folded upward so as not to contact the driven roller 56 moving along the backward path.

Figure 5:
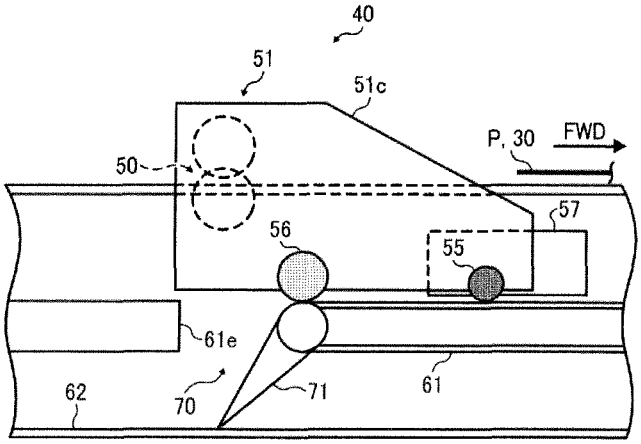
FIG. 5 is a schematic view of a cutter holder of the sheet cutting device having returned to a rolled-sheet cutting area.

As illustrated in FIG. 5, a moving mechanism 70 is disposed at a second end side of the driven-roller guide area 61*b* opposite the first end side in the sheet width direction. When the cutter holder 51 moves from the home position indicated by a solid line in FIG. 10 to the opposite end in the sheet width direction, the moving mechanism 70 shifts the driven roller 56 from the lower guide rail 62 to the upper guide rail 61, that is, returns the cutter holder 51 to a cutting area (rolled-sheet cutting area) of the rolled sheet.

The moving mechanism 70 includes a second connection path 61*e* connecting the backward path on the lower guide rail 62 to the forward path on the upper guide rail 61, and a switching hook 71 disposed adjacent to the second connection path 61*e* at the upper guide rail 61.

The second connection path 61*e* is formed by cutting out a portion of the upper guide rail 61 at the second end side in the sheet width direction (see FIG. 4B).

Figure 9:
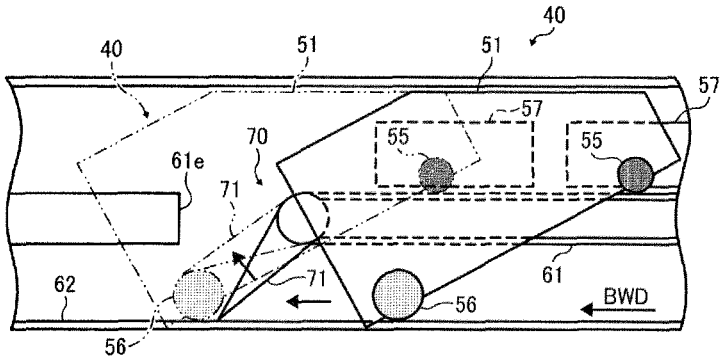
FIG. 9 is a schematic view of the cutter holder returning from the backward path to a home position.
Figure 10:
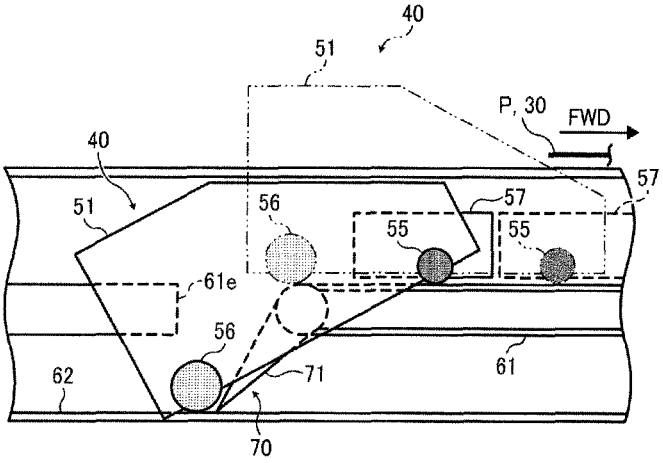
FIG. 10 is a schematic view of the cutter holder returning to the rolled-sheet cutting area.

The switching hook 71 pivots between the backward path and the second connection path 61*e* and is constantly urged downward by an urging member, e.g., a coil spring, so that a tip of the switching hook 71 contacts the lower guide rail 62. As a result, as illustrated in FIG. 9, when the cutter holder 51 moves along the backward path (indicated by an arrow BWD) to the second end side in the sheet width direction, the driven roller 56 contacts the switching hook 71 to pivot the switching hook 71 as indicated by a broken line. In this state, when the driven roller 56 further moves to the second end side in the sheet width direction, the switching hook 71 is separated from the driven roller 56 and returned by the urging member to an initial position, that is, a position indicated by a solid line in FIG. 10. At the initial position indicated by the solid line in FIG. 9, the switching hook 71 is tilted at a predetermined angle. Thus, as illustrated in FIG. 10, when the cutter holder 51 returns from the backward path to the forward path, the driven roller 56 can be moved from the lower guide rail 62 to the upper guide rail 61 via the switching hook 71. The switching hook 71 may be, for example, a leaf spring. In such a case, the urging member is not necessary.

The lower guide rail 62 guides the driven roller 56 of the cutter holder 51 while the cutter holder 51 moves along the backward path.

Next, operation of the sheet cutting device 5 is described with reference to FIGS. 5 to 10.

As illustrated in FIG. 10, before the rolled sheet 30 is cut, the cutter holder 51 is placed at the home position (indicated by the solid line in FIG. 10) at the second end side in the sheet width direction. When an instruction for sheet cutting is received, the driving roller 55 is rotated via the wire 56 (see FIG. 3). As a result, the driving roller 55, while rotating, moves from the cutter home position to the rolled-sheet cutting area (a position indicated by a broken line in FIG. 10), and then moves along the forward path (indicated by an arrow FWD in FIG. 10) to the first end side in the sheet width direction. At this time, the cutter 50 cuts the rolled sheet 30 with the movement of the cutter holder 51.

Figure 7:
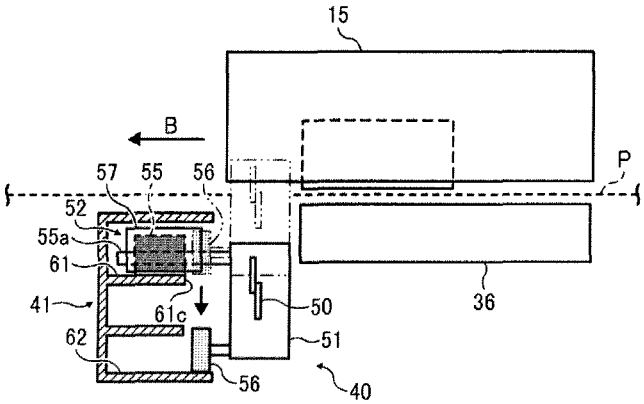
FIG. 7 is a partially cross-sectional side view of the cutter holder shifting to the backward path.

As illustrated in FIG. 6, when the cutter holder 51 moves along the forward path (indicated by the arrow FWD) to the first end side in the sheet width direction across the sheet feed path (indicated by a solid line P), the cutting of the rolled sheet 30 is finished. After the cutter holder 51 moves to the first end side in the sheet width direction, the cutter holder 51 pivots downward in the vertical direction around the rotation shaft 55*a* of the driving roller 55 (see FIG. 4A) under its own weight to switch the moving path from the forward path to the backward path. Specifically, when the driven roller 56 moving on the upper guide rail 61 arrives at the first connection path 61*c*, the driven roller 56 moves from the upper guide rail 61 to the lower guide rail 62 via the first connection path 61*c*. At this time, as illustrated in FIG. 7, with the driving roller 55 retained on the upper guide rail 61, only the driven roller 56 moves to the lower guide rail 62 under its own weight. As a result, in FIG. 7, the cutter holder 51 overlapping with the sheet feed path indicated by a broken line P pivots to take a position with which the cutter holder 51 is movable along the backward path, that is, the position (indicated by a broken line in FIG. 6) with which the cutter holder 51 is retracted from the sheet feed path.

Figure 8:
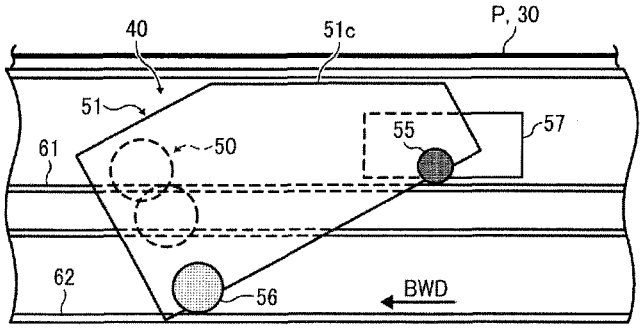
FIG. 8 is a schematic view of the cutter holder moving along the backward path.

Then, based on a position detected with a detector at the first end side in the sheet width direction, the wire 59 (see FIG. 3) is circulated in reverse to rotate the driving roller 55 in reverse, that is, in a direction opposite a direction in which the driving roller 55 rotates on the forward path. Thus, as illustrated in FIG. 8, with the position retracted from the sheet feed path, the cutter holder 51 moves along the backward path (indicated by an arrow BWD) to the second end side in the sheet width direction. At this time, the slanted face 51*c* is parallel to the sheet feed path and, unlike on the forward path, the cutter holder 51 is retracted downward from the sheet feed path. Thus, while the cutter holder 51 moves along the backward path, the rolled sheet 30 can be fed along the sheet feed path, thus enhancing productivity. Such a configuration can also prevent the cutter 50 from contacting the rolled sheet 30 after cutting, thus preventing a cut jam or other failure.

As illustrated in FIG. 9, when the cutter holder 51 moves to the second end side in the sheet width direction and arrives at a position adjacent to the moving mechanism 70, the driven roller 56 contacts the switching hook 71. With the movement of the cutter holder 51, the driven roller 56 pushes up the switching hook 71 as indicated by the broken line in FIG. 9, and moves from the backward path side (the right side of the switching hook 71 in FIG. 9) to the second end side in the sheet width direction, that is, the side of the second connection path 61*e* (the left side of the switching hook 71 in FIG. 9). When the driven roller 56 moves to the side of the second connection path 61*e*, the switching hook 71 is separated from the driven roller 56 and returned by the urging member to the initial position, that is, the position indicated by the solid line in FIG. 9.

Thus, the reciprocal movement of the cutter holder 51 in the sheet width direction is finished. If the rolled sheet 30 is subsequently fed, the above-described reciprocal movement is repeated.

Next, an installation example of the sheet cutting device 5 according to this exemplary embodiment and a configuration of the cutter holder 51 are described with reference to FIGS. 11 to 18.

Figure 11:
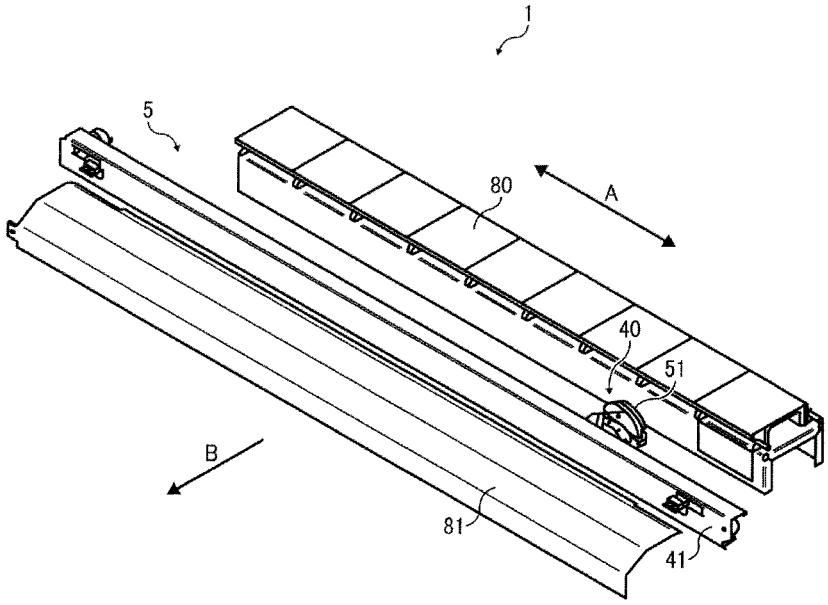
FIG. 11 is an exploded perspective view of the cutter holder, a platen, and a discharge guide plate.
Figure 13:
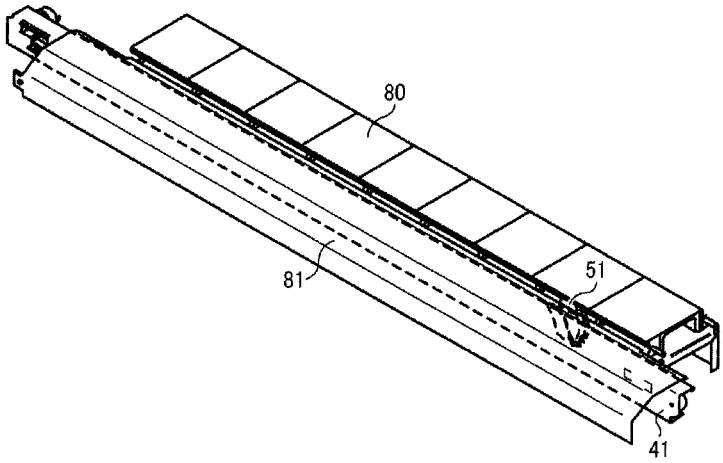
FIG. 13 is a perspective view of the cutter holder moving along the backward path.
Figure 14:
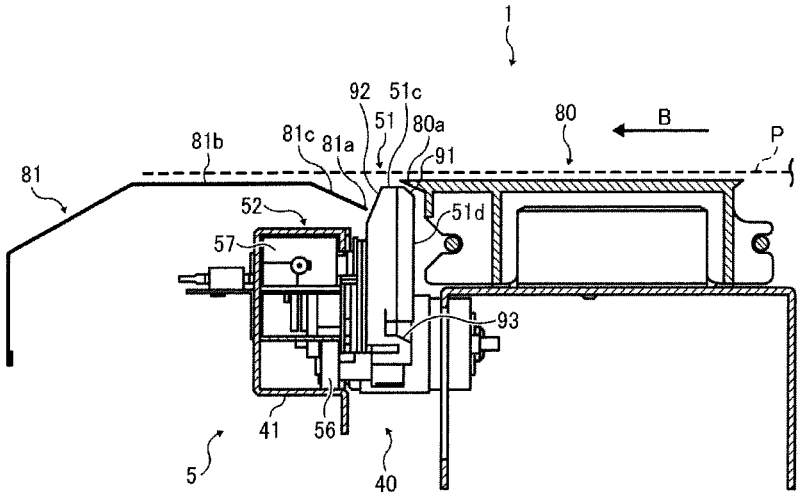
FIG. 14 is a partially cross-sectional side view of the cutter holder moving along the backward path.
Figure 16:
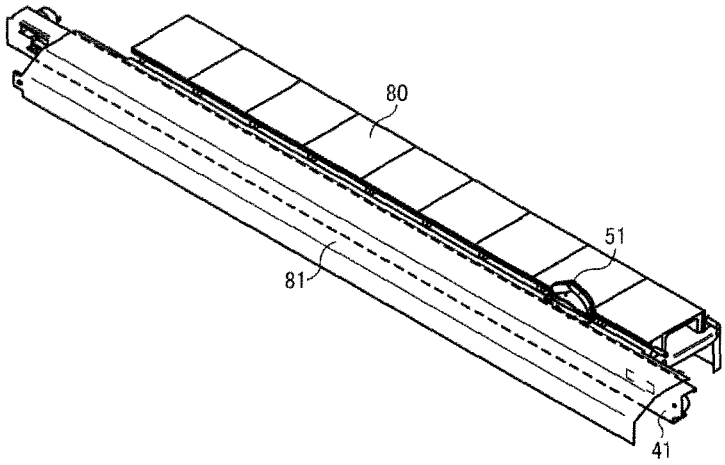
FIG. 16 is a perspective view of the cutter holder moving along the forward path.
Figure 17:
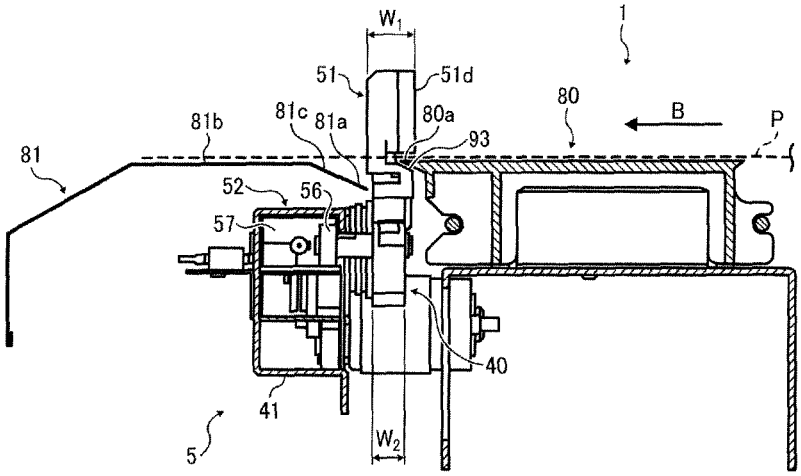
FIG. 17 is a partially cross-sectional side view of the cutter holder moving along the forward path.

As illustrated in FIGS. 11, 14, and 17, the inkjet recording apparatus 1 according to this exemplary embodiment has the platen 80 and a discharge guide plate 81. The sheet feed path is formed on upper faces of the platen 80 and the discharge guide plate 81. The platen 80 is disposed upstream from the cutter holder 51 in the sheet feed direction (indicated by an arrow B in FIG. 11). The discharge guide plate 81 is disposed downstream from the cutter holder 51 in the sheet feed direction B. In other words, the platen 80 and the discharge guide plate 81 are disposed upstream and downstream, respectively, in the sheet feed direction B across the cutter holder 51. In FIG. 11, the platen 80 and the discharge guide plate 81 are disposed away from the cutter holder 51 for convenience of explanation. Actually, as illustrated in FIGS. 13 and 16, the platen 80 and the discharge guide plate 81 are disposed adjacent to the cutter holder 51.

As illustrated in FIGS. 14 and 17, the platen 80 is flat-shaped and has an edge portion 80*a* downstream in the sheet feed direction (hereinafter, downstream edge portion 80*a*). In FIG. 14, the downstream edge portion 80*a* overlaps with the cutter holder 51 in the thickness direction of the rolled sheet 30 perpendicular to the sheet feed direction B.

As illustrated in FIGS. 14 and 17, the discharge guide plate 81 has an edge portion 81*a* upstream in the sheet feed direction (hereinafter, upstream edge portion 81*a*). In FIG. 14, the upstream edge portion 81*a* overlaps with the cutter holder 51 in the thickness direction of the sheet. The discharge guide plate 81 also has a flat portion 81*b* located at substantially the same height as the platen 80 and a scooping portion 81*c* inclined downward from the flat portion 81*b* to the upstream side in the sheet feed direction. The scooping portion 81*c* prevents a subsequent portion of the rolled sheet 30 from entering the interior of the discharge guide plate 81 after cutting.

As described above, in this exemplary embodiment, the discharge guide plate 81 has the scooping portion 81*c*. However, it is to be noted that the shape of the discharge guide plate 81 is not limited to the above-described shape but, for example, the discharge guide plate 81 has the flat portion 81*b* without the scooping portion 81*c*. In such a case, the flat portion 81*b* is preferably disposed at a position lower than the platen 80. Alternatively, the flat portion 81*b* of the discharge guide plate 81 may have rollers to discharge the rolled sheet 30.

Figure 15:
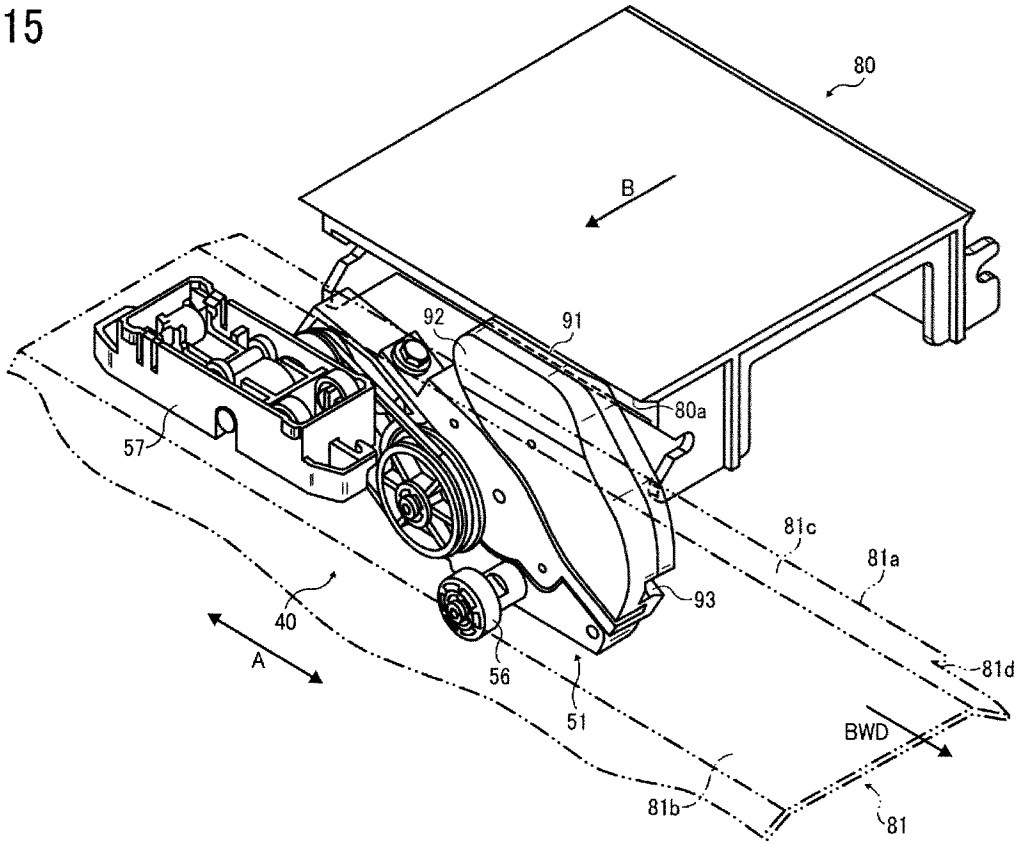
FIG. 15 is an exploded perspective view of the cutter holder, the platen, and the discharge guide plate when the cutter holder moves along the backward path.

As illustrated in FIG. 15, the scooping portion 81*c* has cutout portions 81*d* at opposed ends in the sheet width direction (indicated by an arrow A). In FIG. 15, only one end in the sheet width direction is shown. Similarly, the scooping portion 81*c* has another cutout portion 81*d* at the other end in the sheet width direction. The length of the upstream edge portion 81*a* in the sheet width direction is set to be shorter than the length of each of the flat portion 81*b* and the scooping portion 81*c* in the sheet width direction to form the cutout portions 81*d*. The length of the upstream edge portion 81*a* in the sheet width direction is set to be equal to the length of the platen 80 in the sheet width direction or the sheet feed width SW illustrated in FIG. 3. Specifically, one end of the upstream edge portion 81*a* proximal to the home position of the cutter holder 51 in the sheet width direction is disposed downstream from the slanted face 51*c* in a cutting direction of the rolled sheet 30 (indicated by an arrow FWD in FIG. 5) so as not to contact the slanted face 51*c* when the cutter holder 51 returns to the rolled-sheet cutting area and is placed at the position illustrated in FIG. 5. By contrast, as illustrated in FIG. 6, the other end of the upstream edge portion 81*a* opposite the end proximal to the home position of the cutter holder 51 is disposed upstream in the cutting direction of the rolled sheet 30 (indicated by the arrow FWD in FIG. 6) from a trajectory on which the cutter holder 51 pivots to shift from the forward path to the backward path, so as not to overlap with the pivoting trajectory of the cutter holder 51.

As a result, the cutter holder 51 passes through the cutout portions 81*d* when shifting from the forward path to the backward path and from the backward path to the forward path. Thus, even in a case where the upstream edge portion 81*a* overlaps with the cutter holder 51 in the thickness direction of the rolled sheet 30, the cutter holder 51 is pivotable between below and above the discharge guide plate 81 without contacting the discharge guide plate 81.

As described above, in this exemplary embodiment, the cutout portions 81*d* allow pivoting of the cutter holder 51. It is to be noted that the configuration of the scooping portion 81*c* is not limited to the above-described configuration but, for example, the length of each of the scooping portion 81*c* and the flat portion 81*b* in the sheet width direction may be set to be equal to the length of the upstream edge portion 81*a* to allow pivoting of the cutter holder 51.

In this exemplary embodiment, the platen 80 and the discharge guide plate 81 serve as a feed guide plate unit. The platen 80 serves as a first feed guide plate, and the discharge guide plate 81 serves as a second feed guide plate.

The cutter holder 51 is disposed between the downstream edge portion 80*a* of the platen 80 and the upstream edge portion 81*a* of the discharge guide plate 81. The cutter holder 51 partially overlaps with both the downstream edge portion 80*a* and the upstream edge portion 81*a* in the thickness direction of the rolled sheet 30 perpendicular to the sheet feed direction.

Specifically, the cutter holder 51 has a first escape portion 91, a second escape portion 92, and a third escape portion 93 that overlap with the downstream edge portion 80*a* and the upstream edge portion 81*a* when the cutter holder 51 moves along the forward path and the backward path.

As illustrated in FIGS. 12A and 14, the slanted face 51*c* of the cutter holder 51 has the first escape portion 91 at the upstream side in the sheet feed direction (indicated by an arrow B). The first escape portion 91 is cut out in a tapered shape so as to incline at a predetermined angle from the slanted face 51*c* toward the upstream side in the sheet feed direction.

Thus, as illustrated in FIGS. 14 and 15, when the cutter holder 51 moves along the backward path, the first escape portion 91 of the cutter holder 51 overlaps with the downstream edge portion 80*a* of the platen 80 in the thickness direction of the rolled sheet 30. In other words, since the first escape portion 91 is cut out in the tapered shape, the first escape portion 91 overlaps with the downstream edge portion 80*a* in the thickness direction of the rolled sheet 30 without contacting the downstream edge portion 80*a*. As a result, the downstream edge portion 80*a* can be placed adjacent to the cutting position of the cutter 50, thus allowing stable feeding and cutting of the rolled sheet 30.

As illustrated in FIG. 15, when the cutter holder 51 moves along the backward path, the slanted face 51*c* serves as an upper end of the cutter holder 51.

As illustrated in FIGS. 12B and 14, the slanted face 51*c* of the cutter holder 51 also has the second escape portion 92 at the downstream side in the sheet feed direction (indicated by the arrow B). The second escape portion 92 is cut out in a tapered shape so as to incline at a predetermined angle from the slanted face 51*c* toward the downstream side in the sheet feed direction.

Thus, as illustrated in FIGS. 14 and 15, when the cutter holder 51 moves along the backward path, the second escape portion 92 of the cutter holder 51 overlaps with the upstream edge portion 81*a* of the discharge guide plate 81 in the thickness direction of the rolled sheet 30. In other words, since the second escape portion 92 is cut out in the tapered shape, the second escape portion 92 overlaps with the upstream edge portion 81*a* in the thickness direction of the rolled sheet 30 without contacting the upstream edge portion 81*a*. As a result, the upstream edge portion 81*a* can be placed adjacent to the cutting position of the cutter 50, thus allowing stable feeding and cutting of the rolled sheet 30.

The upstream edge portion 81*a* of the discharge guide plate 81 is disposed lower than the downstream edge portion 80*a* of the platen 80. As a result, the inclination angle of the second escape portion 92 is set to be greater than that of the first escape portion 91 so that the second escape portion 92 can overlap with the upstream edge portion 81*a* in the thickness direction of the rolled sheet 30. It is to be noted that the inclination angles of the first escape portion 91 and the second escape portion 92 are not limited to the above-described angles but may be optimally set in accordance with, for example, the shapes of the platen 80 and the discharge guide plate 81 and/or the positions of the downstream edge portion 80*a* and the upstream edge portion 81*a*.

In this exemplary embodiment, the first escape portion 91 and the second escape portion 92 are tapered. However, it is to be noted that the shapes of the first escape portion 91 and the second escape portion 92 are not limited to the tapered shapes but may be, for example, stepwise or curved toward the interior of the cutter holder 51.

As illustrated in FIGS. 12A and 17, the cutter holder 51 has the third escape portion 93 at a side face portion 51*d* upstream in the sheet feed direction (indicated by the arrow B). The third escape portion 93 is a recessed groove having a depth enabling the downstream edge portion 80*a* of the platen 80 to protrude toward the interior of the cutter holder 51.

Figure 18:
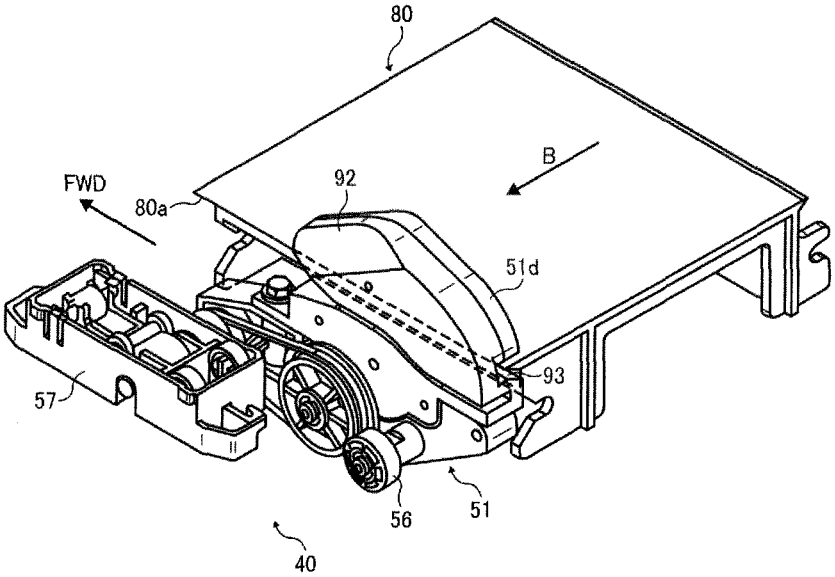
FIG. 18 is a perspective view of the cutter holder, the platen, and the discharge guide plate when the cutter holder moves along the forward path.

Thus, as illustrated in FIGS. 17 and 18, when the cutter holder 51 moves along the forward path, the third escape portion 93 of the cutter holder 51 overlaps with the downstream edge portion 80*a* of the platen 80 in the thickness direction of the rolled sheet 30. In other words, since the third escape portion 93 is formed as the recessed groove, the third escape portion 93 overlaps with the downstream edge portion 80*a* without contacting the downstream edge portion 80*a*. As a result, the downstream edge portion 80*a* can be placed adjacent to the cutting position of the cutter 50, thus allowing stable feeding and cutting of the rolled sheet 30.

As illustrated in FIG. 17, in the cutter holder 51, the width W1 of a portion higher than the upstream edge portion 81*a* when the cutter holder 51 moves along the forward path is set to be greater than the width W2 of a portion lower than the upstream edge portion 81*a* (W1>W2). Such a configuration prevents the cutter holder 51 from contacting the upstream edge portion 81*a* of the discharge guide plate 81 when the cutter holder 51 moves along the forward path.

Thus, as illustrated in FIGS. 14 and 17, the discharge guide plate 81 overlaps with the guide member 41 in the thickness direction of the sheet. As a result, even in a case where the discharge guide plate 81 is provided in addition to the guide member 41, the discharge guide plate 81 can be placed adjacent to the cutter holder 51 regardless of the position of the guide member 41. Thus, the width of the apparatus main unit 1*a* in the sheet feed direction can be shortened, thus allowing a reduction in the size of the apparatus main unit 1*a*.

As described above, in this exemplary embodiment, the guide member 41 is disposed downstream from the cutter holder 51 in the sheet feed direction. It is to be noted that the position of the guide member 41 is not limited to the above-described position but, for example, the guide member 41 may be disposed upstream from the cutter holder 51 in the sheet feed direction. In such a case, the platen 80 and the guide member 41 are disposed so as to overlap in the thickness direction of the sheet. Such a configuration can obtain effects equivalent to the effects of the above-described exemplary embodiment.

As described above, in the sheet cutting device according to this exemplary embodiment, the cutter holder 51 partially overlaps with both the platen 80 and the discharge guide plate 81 in the thickness direction of the sheet perpendicular to the sheet feed direction. Such a configuration allows the platen 80 and the discharge guide plate 81 to be placed more adjacent to the cutter holder 51 than a conventional configuration. As a result, the width of the apparatus main unit 1*a* in the sheet feed direction can be shortened, thus allowing a reduction in the size of the apparatus main unit 1*a*.

In the sheet cutting device according to this exemplary embodiment, the cutter holder 51 has the first escape portion 91 that overlaps with the downstream edge portion 80*a* of the platen 80 in the thickness direction of the rolled sheet 30. Such a configuration allows the downstream edge portion 80*a* of the platen 80 to be placed adjacent to the cutter holder 51 when the cutter holder 51 moves along the backward path.

In the sheet cutting device according to this exemplary embodiment, the cutter holder 51 has the second escape portion 92 that overlaps with the upstream edge portion 81*a* of the discharge guide plate 81 in the thickness direction of the rolled sheet 30. Such a configuration allows the upstream edge portion 81*a* of the discharge guide plate 81 to be placed adjacent to the cutter holder 51 when the cutter holder 51 moves along the backward path.

In the sheet cutting device according to this exemplary embodiment, the cutter holder 51 has the third escape portion 93 that overlaps with the downstream edge portion 80*a* and the platen 80 in the thickness direction of the rolled sheet 30. Such a configuration allows the downstream edge portion 80*a* of the platen 80 to be placed adjacent to the cutter holder 51 when the cutter holder 51 moves along the forward path.

As described above, in this exemplary embodiment, the cutter holder 51 has the first escape portion 91, the second escape portion 92, and the third escape portion 93. However, it is to be noted that the configuration of the cutter holder 51 is not limited to the above-described configuration but, for example, the cutter holder 51 may have at least one of the above-described escape portions in accordance with the shapes and positions of the platen 80 and the discharge guide plate 81.

Figure 19:
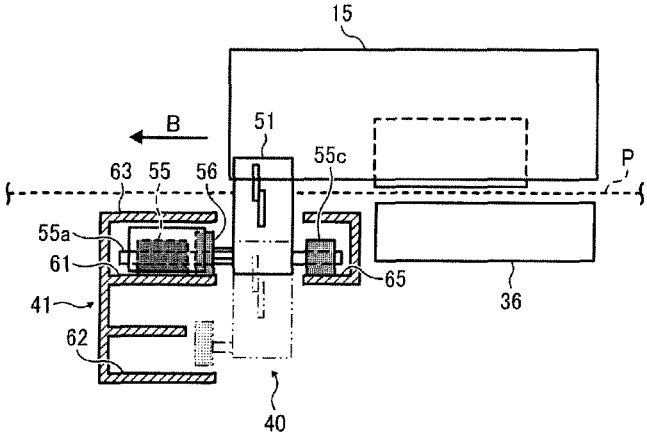
FIG. 19 is a schematic side view of a sheet cutting device according to another exemplary embodiment of this disclosure.

In this exemplary embodiment, as illustrated in FIGS. 4A and 4B, the driving roller 55 is disposed at only one side of the cutter holder 51, that is, the downstream side of the cutter holder 51 in the sheet feed direction B. However, it is to be noted that the configuration of the driving roller 55 is not limited to the above-described configuration but, for example, as illustrated in FIG. 19, besides the driving roller 55, another driving roller 55*c* may be disposed at a side opposite the side at which the driving roller 55 is disposed. In other words, the driving roller 55 and the driving roller 55*c* may be disposed facing each other across the cutter holder 51. In such a case, besides the upper guide rail 61 at the downstream side in the sheet feed direction, another guide rail 65 is disposed corresponding to the driving roller 55*c*. In such a case, the guide rail 65 is disposed so as to overlap with the platen 80 in the thickness direction of the sheet.

In the above-described exemplary embodiments, the cutter holder 51 has the driving roller 55 at the first end side in the sheet width direction and the driven roller 56 at the second end side in the sheet width direction. However, the configuration of the cutter holder 51 is not limited to such a configuration, and for example, the positions of the driving roller 55 and the driven roller 56 are interchangeable. In such a case, the cutter holder 51 pivots in a direction opposite the pivoting direction of the cutter holder in the above-described exemplary embodiments. Accordingly, the arrangement of the slanted face 51*c* is modified according to the pivoting direction.

In this exemplary embodiment, the cutter holder 51 is retracted downward in the vertical direction. However, it is to be noted that the configuration of the cutter holder 51 is not limited to the above-described configuration but, for example, in a case where the sheet cutting device 5 is not horizontally disposed relative to the apparatus main unit 1*a*, the cutter holder may be retracted in the thickness direction of the rolled sheet 30 in accordance with the inclination of the sheet cutting device 5.

Alternatively, the cutter holder may be retracted upward in the vertical direction. In such a case, the guide member is disposed above the sheet feed path, the forward path of the cutter holder is disposed on the lower guide rail, and the backward path is disposed on the upper guide rail. As a result, after the cutter holder moves along the forward path to cut the rolled sheet, the driven roller shifts onto the upper guide rail via a moving mechanism corresponding to the moving mechanism 70 of the above-described exemplary embodiment. Thus, the cutter holder is retracted from the sheet feed path so as to be movable along the backward path. After the cutter holder moves along the backward path, the driven roller shifts onto the lower guide rail via a communication path corresponding to the first connection path 61*c* of the above-described exemplary embodiment. Thus, the cutter holder takes a position for cutting the rolled sheet. In such a configuration, a slanted face corresponding to the slanted face 51*c* of the above-described exemplary embodiment is disposed at a lower end of the cutter holder. As a result, the first escape portion 91 and the second escape portion 92 are also disposed at the lower end of the cutter holder. Such a configuration can obtain effects equivalent to the effects described in the above-described exemplary embodiment.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet cutting device comprising:

a cutter holder accommodating a cutter, the cutter having opposed blades opposing each other to cut a sheet of recording media fed along a sheet feed path of a feed guide plate unit;

a moving unit holding the cutter holder and movable in a sheet width direction perpendicular to a sheet feed direction in which the sheet is fed along the sheet feed path; and a guide member disposed along the sheet width direction to guide the moving unit in the sheet width direction, wherein the cutter holder partially overlaps with the feed guide plate unit in a thickness direction of the sheet perpendicular to both the sheet width direction and the sheet feed direction, and wherein the moving unit moves the cutter holder accommodating the cutter including the opposed blades from a home position, along a forward path in the sheet width direction to cut the sheet of recording media, and after the sheet is cut with the cutter, retracts the cutter including both of the opposed blades downward below the sheet feed path of the sheet of recording media in the thickness direction to a retracted position, to move the cutter holder in a backward path back to the home position.

2. The sheet cutting device according to claim 1, wherein the cutter holder has an escape portion that overlaps with the feed guide plate unit in the thickness direction of the sheet.

3. The sheet cutting device according to claim 1, wherein the guide member has a first path to guide the cutter holder in the sheet width direction to cut the sheet with the cutter and a second path to guide the cutter holder in the sheet width direction after the sheet is cut with the cutter, the second path disposed away from the first path in the thickness direction of the sheet, and when the cutter holder moves along the second path, the cutter holder is retracted away from the sheet feed path in the thickness direction of the sheet.

4. The sheet cutting device according to claim 3, wherein the cutter holder has a first escape portion at an upper end thereof upstream in the sheet feed direction, and the first escape portion overlaps with the feed guide plate unit in the thickness direction of the sheet when the cutter holder moves along the second path.

5. The sheet cutting device according to claim 4, wherein the cutter holder has a slanted face that is inclined at an angle from the sheet feed path toward the thickness direction of the sheet when the cutter holder moves along the first path and is parallel to the sheet feed path when the cutter holder moves along the second path, and the first escape portion is formed at the slanted face.

6. The sheet cutting device according to claim 3, wherein the cutter holder has a second escape portion at an upper end thereof downstream in the sheet feed direction, and the second escape portion overlaps with the feed guide plate unit in the thickness direction of the sheet when the cutter holder moves along the second path.

7. The sheet cutting device according to claim 6, wherein the cutter holder has a slanted face that is inclined at an angle from the sheet feed path toward the thickness direction of the sheet when the cutter holder moves along the first path and is parallel to the sheet feed path when the cutter holder moves along the second path, and the second escape portion is formed at the slanted face.

8. The sheet cutting device according to claim 3, wherein the cutter holder has a third escape portion at a side face thereof upstream in the sheet feed direction, and the third escape portion overlaps with the feed guide plate unit in the thickness direction of the sheet when the cutter holder moves along the first path.

9. The sheet cutting device according to claim 3, wherein the cutter holder has an upper part and a lower part positioned higher and lower, respectively, than the sheet when the cutter holder moves along the first path, and the upper part has a width greater than a width of the lower part.

10. The sheet cutting device according to claim 1, wherein the guide member overlaps with the feed guide plate unit in the thickness direction of the sheet.

11. An image forming apparatus comprising:

an image forming device that forms an image on a sheet of recording media;

a sheet feed device that has a feed guide plate unit forming a sheet feed path thereon and feeds the sheet having the image formed thereon along the sheet feed path; and a sheet cutting device that cuts the sheet fed along the sheet feed path, the sheet cutting device comprising:

a cutter holder accommodating a cutter, the cutter having opposed blades opposing each other to cut a sheet of recording media fed along the sheet feed path;

a moving unit holding the cutter holder and movable in a sheet width direction perpendicular to a sheet feed direction in which the sheet is fed along the sheet feed path; and a guide member disposed along the sheet width direction to guide the moving unit in the sheet width direction, wherein the cutter holder partially overlaps with the feed guide plate unit in a thickness direction of the sheet perpendicular to both the sheet width direction and the sheet feed direction, and wherein the moving unit moves the cutter holder accommodating the cutter including the opposed blades from a home position, along a forward path in the sheet width direction to cut the sheet of recording media, and after the sheet is cut with the cutter, retracts the cutter including both of the opposed blades downward below the sheet feed path of the sheet of recording media in the thickness direction to a retracted position, to move the cutter holder in a backward path back to the home position.

12. The image forming apparatus according to claim 11, wherein the guide member has a first path to guide the cutter holder in the sheet width direction to cut the sheet with the cutter and a second path to guide the cutter holder in the sheet width direction after the sheet is cut with the cutter, the second path disposed away from the first path in the thickness direction of the sheet, and when the cutter holder moves along the second path, the cutter holder is retracted away from the sheet feed path in the thickness direction of the sheet.

13. The image forming apparatus according to claim 12, wherein the feed guide plate unit has a first feed guide plate disposed upstream from the cutter holder in the sheet feed direction, the cutter holder has a first escape portion at an upper end thereof upstream in the sheet feed direction, and in the thickness direction of the sheet, the first escape portion overlaps with an edge portion of the first feed guide plate downstream in the sheet feed direction when the cutter holder moves along the second path.

14. The image forming apparatus according to claim 12, wherein the feed guide plate unit has a second feed guide plate disposed downstream from the cutter holder in the sheet feed direction, the cutter holder has a second escape portion at an upper end thereof downstream in the sheet feed direction, and in the thickness direction of the sheet, the second escape portion overlaps with an edge portion of the second feed guide plate upstream in the sheet feed direction when the cutter holder moves along the second path.

15. Image forming apparatus according to claim 12, wherein the feed guide plate unit has a first feed guide plate disposed upstream the cutter holder in the sheet feed direction, the cutter holder has a third escape portion at a side face thereof upstream in the sheet feed direction, and in the thickness direction of the sheet, the third escape portion overlaps with an edge portion of the first feed guide plate downstream in the sheet feed direction when the cutter holder moves along the first path.

16. The image forming apparatus according to claim 12, wherein the feed guide plate unit has a cutout portion to prevent the cutter holder from contacting the feed guide plate unit when the cutter holder shifts from the first path to the second path.

17. The sheet cutting device according to claim 1, wherein the moving unit includes a rotation shaft by which the cutter holder is connected to the moving unit, wherein the cutter holder switches between a first position with which, on the forward path, the cutter holder cuts the sheet with the cutter, and a second position with which, on the backward path, the cutter holder is retracted from the sheet feed path.

* * * * *